US006688059B1

(12) United States Patent
Walker

(10) Patent No.: US 6,688,059 B1
(45) Date of Patent: Feb. 10, 2004

(54) PROTECTIVE TRIM STRIP FOR DECKS

(75) Inventor: Kenneth E. Walker, 4851 12 O'clock Knob Rd., Roanoke, VA (US) 24018

(73) Assignee: Kenneth E. Walker, Roanoke, VA (US)

( * ) Notice: Subject to any disclaimer, the term of this patent is extended or adjusted under 35 U.S.C. 154(b) by 0 days.

(21) Appl. No.: 10/310,844

(22) Filed: Dec. 6, 2002

(51) Int. Cl.[7] ..... E04B 1/70; E04D 13/04

(52) U.S. Cl. ..... 52/302.3; 52/478; 52/506.05; 52/730.1; 52/748.1

(58) Field of Search ..... 52/302.1, 302.3, 52/468, 478, 537, 11, 506.01, 506.05, 730.1, 748.1

(56) References Cited

U.S. PATENT DOCUMENTS

| | | | | | |
|---|---|---|---|---|---|
| 3,111,788 | A | * | 11/1963 | Ouellet | 52/537 |
| 3,343,312 | A | * | 9/1967 | Tischuk | 52/94 |
| 3,759,007 | A | * | 9/1973 | Thiele | 52/533 |
| 4,065,883 | A | | 1/1978 | Thibodeau | |
| 4,192,117 | A | * | 3/1980 | Heirich | 52/478 |
| 4,373,315 | A | * | 2/1983 | Farrant | 52/522 |
| 4,697,399 | A | | 10/1987 | Ryan | |
| 4,860,502 | A | | 8/1989 | Mickelsen | |
| 5,195,281 | A | | 3/1993 | Kosko | |
| 5,765,328 | A | | 6/1998 | Moore | |
| 5,927,028 | A | * | 7/1999 | Rossi | 52/202 |
| 6,164,019 | A | | 12/2000 | Salley | |
| 6,212,837 | B1 | | 4/2001 | Davis et al. | |
| 6,226,941 | B1 | * | 5/2001 | Stevens | 52/302.3 |
| 6,244,007 | B1 | * | 6/2001 | Heikkila | 52/302.3 |
| 6,279,271 | B1 | | 8/2001 | Burkart, Jr. | |
| 6,308,479 | B1 | | 10/2001 | Prohofsky | |
| 6,336,300 | B1 | | 1/2002 | Babucke | |
| 6,343,450 | B1 | | 2/2002 | Vance, Jr. | |
| 6,393,785 | B1 | * | 5/2002 | Burt | 52/302.3 |
| 6,415,571 | B2 | * | 7/2002 | Risser | 52/302.1 |
| 6,421,967 | B1 | * | 7/2002 | Wlaker | 52/198 |
| 2003/0074850 | A1 | * | 4/2003 | Ready et al. | 52/302.1 |

* cited by examiner

*Primary Examiner*—Carl D. Friedman
*Assistant Examiner*—Brian E. Glessner

(57) ABSTRACT

A protective trim strip having an "M"-shaped lateral cross-section is provided with a lengthwise channel along one edge and a lengthwise flange edge extending outwardly from the strip. A plurality of the trim strips are attached, using nails or screws, in a side-by-side and overlapping fashion onto the joists of a deck to direct water run-off away from the building to which the deck is attached, thereby protecting the deck joists and area under the deck from standing water. The flange edge of each strip is placed into the channel of the neighboring strip to improve the overlap. A foam adhesive can be used to adhere the flange edges of each strip into the corresponding channel of the neighboring strip.

7 Claims, 5 Drawing Sheets

PROTECTIVE TRIM STRIP FOR DECKS

BACKGROUND OF THE INVENTION

1. Field of the Invention

The present invention relates to protective trim strips for decks, and particularly to trim strips that can be applied side-by-side in overlapping fashion to the joists to direct water run-off away from the building to which the deck is attached, as well as to provide an aesthetically pleasing appearance when viewed from underneath the deck.

2. Description of the Related Art

The present invention is directed to protective trim strips applied to home deck structures. In particular, the invention is a contoured strip, a plurality of which can be attached to the joists of existing or new decks to direct water run-off away from the building to which the deck is attached and to provide an aesthetically pleasing appearance.

Deck structures are typically built to extend outwardly from houses and other buildings to provide additional surface area above the ground or grade level. They provide support for various kinds of home activities, such as barbecue events, lounging, sun-tanning, and get togethers with family and neighbors.

During periods of precipitation, e.g., rain or snow, large amounts of water can run over the deck surface and between the deck planks. It is important to ensure that the water run-off is directed away from the house or other building to avoid problems that can otherwise occur, such as flooding in the lower levels of the building. Another problem that can occur is rotting or deterioration of the joists from slow drainage of surface water. Decks are generally constructed with a plurality of deck planks that are fastened (e.g., with nails) to a series of parallel joists, thereby providing the upper support surface of the deck. The joists typically extend outward from the building and themselves rest on two or more beams that extend perpendicularly to the direction of the joists. Finally, the beams rest on vertically arranged weight-supporting posts.

The present invention solves the problem of water run-off from the decks by providing a contoured protective trim strip in which a plurality of the strips are attached to the joists of the deck to direct water run-off away from the building. Also, the strips provide an aesthetically pleasing appearance to the deck when viewed from the space below the deck. The related art shows various efforts which have been made to address these problems, as well as related problems.

U.S. Pat. No. 4,065,883, issued to Thibodeau on Jan. 3, 1978, teaches spaced water conducting members mounted on beams (joists) to direct water run-off away from a building. U.S. Pat. No. 4,697,399, issued to Ryan on Oct. 6, 1987, teaches a universal deck made using a plurality of parallel overlapping corrugated members that direct water run-off away from the building. U.S. Pat. No. 4,860,502, issued to Mickelsen on Aug. 29, 1989, teaches a deck gutter system in which a series of gutters are mounted onto an existing deck to ensure water run-off in a direction away from the building.

U.S. Pat. No. 5,195,281, issued to Kosko on Mar. 23, 1993, teaches a deck trough that is mounted onto existing deck joists to create a water-proof roof for the space below the deck. U.S. Pat. No. 5,765,328, issued to Moore on Jun. 16, 1998, teaches a deck drainage system using a plurality of side-by-side flexible channels mounted onto the deck joists.

U.S. Pat. No. 6,164,019, issued to Salley on Dec. 26, 2000, teaches dry deck rain trays that are mounted onto the deck joists.

U.S. Pat. No. 6,212,837, issued to Davis et al. on Apr. 10, 2001, teaches a rain water diverter system for deck structures. U.S. Pat. No. 6,279,271, issued to Burkart, Jr. on Aug. 28, 2001, teaches an under-deck water shedding system using a grid structure of panels. U.S. Pat. No. 6,308,479, issued to Prohofsky on Oct. 30, 2001, teaches a rain water diverter system for deck structures.

U.S. Pat. No. 6,336,300, issued to Babucke on Jan. 8, 2002, teaches a device to divert water from a deck. U.S. Pat. No. 6,343,450, issued to Vance, Jr. on Feb. 5, 2002, teaches a snap-together drainage system for decks and canopies.

Although various shapes and structures of trim strips that are applied to decks, including joists, for the purpose of water drainage, etc. are taught in the references, none teach trim strips having the structure of the present invention. The inventive trim strips taught herein have edge features that result in the desirable edge-into-channel overlapping structure that ensures that water flow is directed away from the building. Also, the trim strips are provided with an additional slope feature that ensures rapid water flow away from the building.

None of the above inventions and patents, taken either singularly or in combination, is seen to describe the instant invention as claimed. Thus protective trim strips for decks solving the aforementioned problems are desired.

SUMMARY OF THE INVENTION

The invention is directed to a contoured protective trim strip for decks, in which a plurality of the inventive strips are placed in overlapping and side-by-side fashion onto the joists of the deck. The strips are structured to direct any water flowing from the deck, e.g., run-off due to precipitation, etc., to be directed away from the building to which the deck is attached.

The protective trim strips of the present invention are elongated strips of vinyl having a length coextensive with the length of the deck joists and having either an "M" shape or a "W" shape in transverse section, depending on whether the strips will be mounted above or below the joists, in order to define either one or two V-shaped troughs which have a gradual taper extending away from the deck ledger board. One elongated strip edge has a first flange extending parallel to the top or bottom edge of the joist, while the opposite elongated strip edge has a second flange slightly wider than the first flange extending parallel to the joist edge with a third flange normal to the second, so that the edges of adjacent strips can be overlapped or nested. The overall width of the strip is preferably dimensioned to extend between the conventional sixteen inch on center joist spacing commonly used in deck construction. The vinyl may be textured to resemble house siding.

The strips can be applied as an after-market retrofit in a side-by-side fashion to cover the bottom of the joists of existing decks. In this way, the strips provide a gutter system directing any collected water away from the building to which the deck is attached. The resulting system of overlapping strips also provides a roof having an aesthetically appearance for the space under the deck.

Alternatively, the strips can be applied to the tops of the joists during construction of a new deck before the deck planks have been attached to the joists. This arrangement directs water run-off away from the building and protects the joists from water damage as well.

Accordingly, it is a principal object of the invention to provide a contoured protective trim strip that can be applied to deck joists to provide an aesthetically pleasing appearance as well as direct water run-off away from the building.

It is another object of the invention to provide a deck structure that is modified to include the above protective trim strips.

It is an object of the invention to provide improved elements and arrangements thereof for the purposes described which is inexpensive, dependable and fully effective in accomplishing its intended purposes.

These and other objects of the present invention will becomes readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
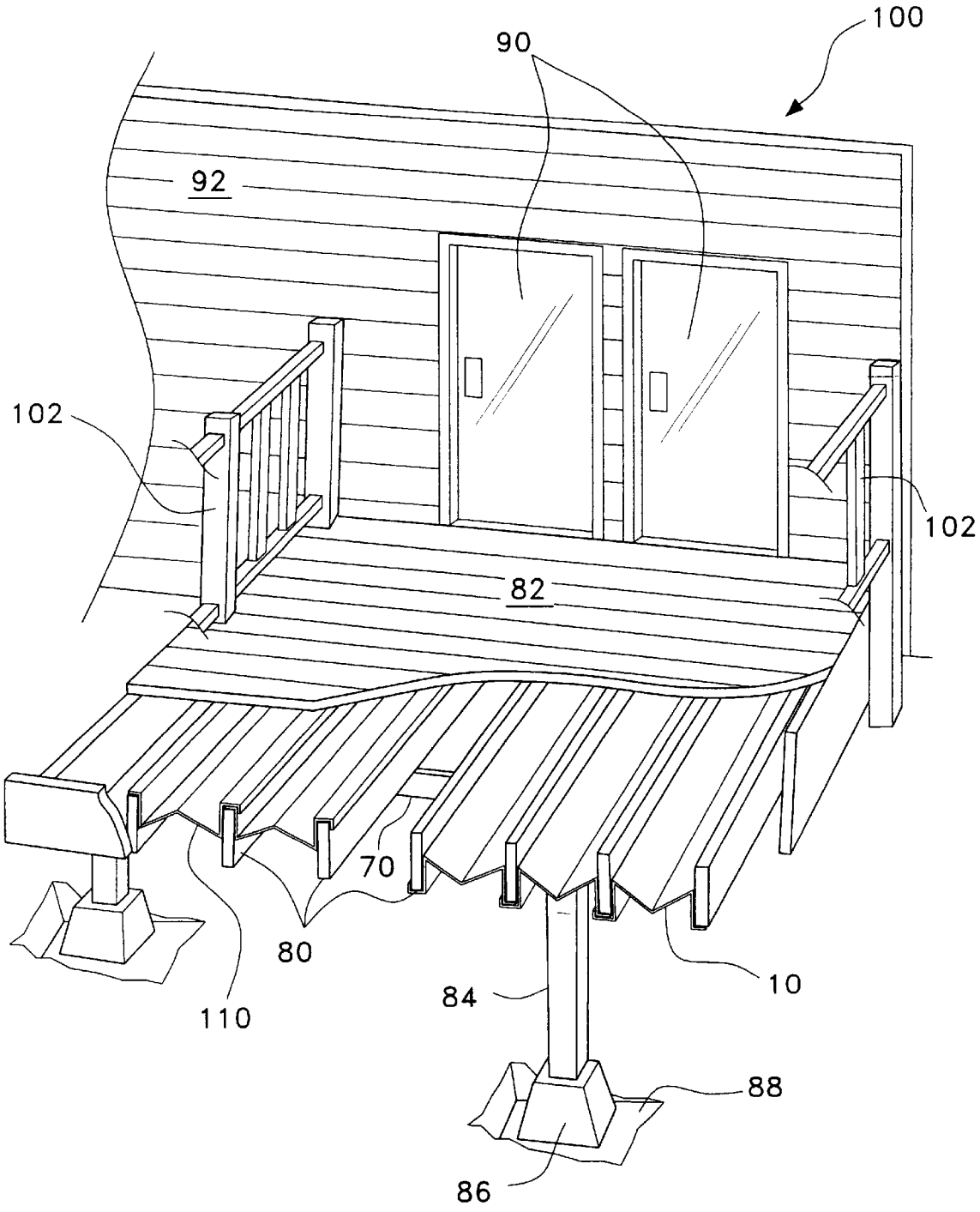
FIG. 1 is an environmental, perspective view of a deck including the protective strips according to the present invention the deck being broken away to show over the joist construction on the left side and under the joist construction on the right side.

The present invention is directed to contoured protective trim strips used on deck structures which facilitate drainage of surface water to preserve the deck substructure from the effects of weather and channel rain water away from the building foundation, to provide a roof which protects the area beneath the deck from water drainage, and to provide a decorative trim beneath the surface of the deck. FIG. 1 shows a perspective cutaway view of a typical deck 100 extending outward from a wall 92 of a building. In this case, the deck extends outwardly from the bottoms of the doors 90. Portions of railings 102 are also shown.

The top surface 82 of the deck 100 (only a portion of the deck surface is shown in cutaway in FIG. 1) is made up of a series of deck planks that are placed side-by-side from one side of the deck to the other. The deck planks are attached to a series of parallel joists 80, which extend away from the building. The joists 80 are typically 2'×6' or 2'×8' boards placed on edge to rest on one or more beams 70 that extend perpendicular to the joists 80. The ends of the beams 70 rest on posts 84 that provide vertical support for the deck 100. The posts 84 shown in FIG. 1 rest on concrete piers 86, which, in turn, rest on concrete footings 88.

The space underneath the deck is often available for other activities, e.g., barbecues, etc. Underneath most decks, the joists and the other supporting structure for the deck are exposed and visible.

When applied to the bottom edge of the joists 80, the protective trim strips 10 of the present invention appear to have an "M" shape, i.e., their cross-sections and their pattern as viewed from the end of the strips resemble the letter "M", as seen in the right side of FIG. 1. This "M" pattern is shown in detail in the perspective view in FIG. 2A, in the end view of FIGS. 3, and in the section view of FIG. 5. Hereinafter, strips 10 having an "M" orientation will be referred to as "under-joist" trim strips.

Conversely, when applied to the top edges of the joists 80, the protective trim strips 110 of the present invention appear to have a "W" shape, i.e., their cross-sections and their pattern as viewed from the end of the strips resemble the letter "W", as shown in the left side of FIG. 1 (FIG. 1 shows the "M" and "W" configurations side-by-side for comparative and illustrative, purposes only, it being understood that a single deck would not feature both configurations together). This "W" pattern is shown in detail in the perspective view of FIG. 2B, in the end view of FIG. 4, and in the section view of FIG. 6. Hereinafter, the strips 110 having a "W" orientation will be referred to as "over-joist" trim strips.

Details of the under-joist trim strip 10 will be discussed in relation to FIGS. 2A, 3 and 5. The under-joist trim strips 10 are applied to the bottom edges of the joists 80, as in the right side of the deck 100 of FIG. 1. As shown, the under-joist trim strip 10 has several elongated panels connected together along their lengths.

Figure 2A:
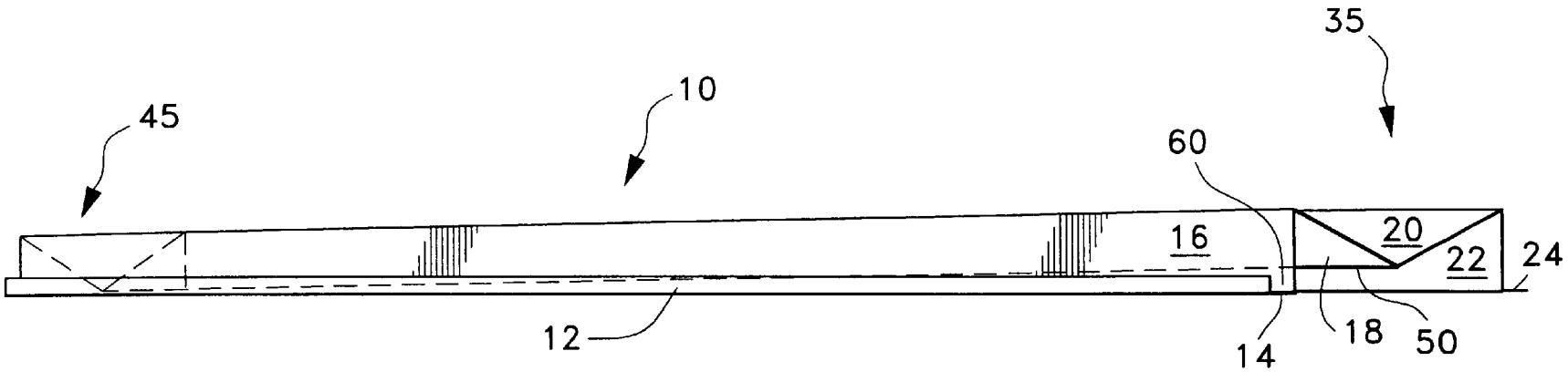
FIG. 2A shows a side perspective view of a protective trim strip according to the present invention configured in an "M" shape in section for attachment to the bottom edges of the joists.
Figure 3:
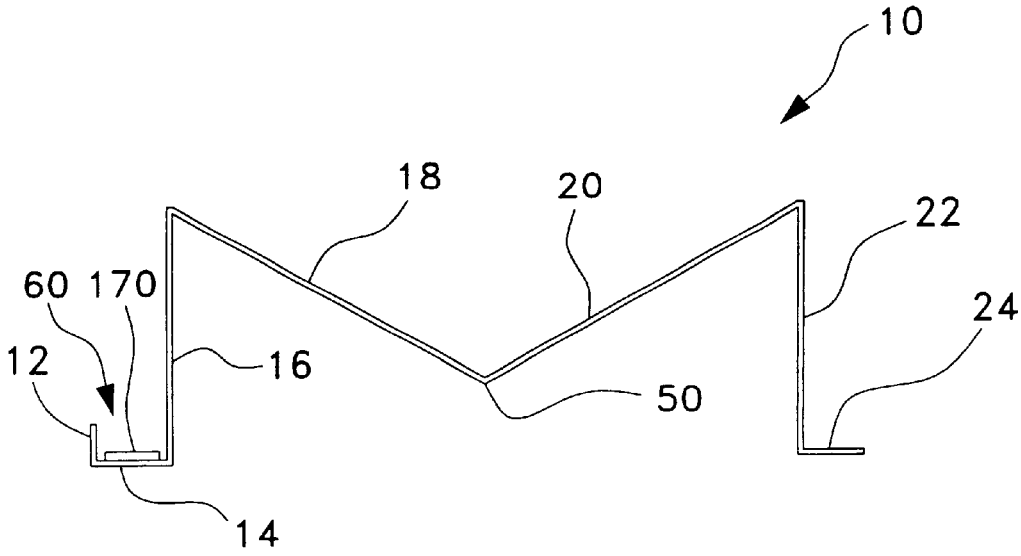
FIG. 3 shows an end view of the protective trim strip of FIG. 2A.

Referring to FIG. 2A, the two center panels 18 and 20 are connected along a common edge forming a ridge 50. The V-shaped channel formed between these panels extends the entire length of the strip 10, as shown partially in hidden lines in FIG. 2A. The V-shaped channel forms a drainage trough for draining water away from the building. Two parallel side panels 16 and 22 are connected to the center panels, 18 and 20, respectively. Extending from side panel 22 is an outwardly projecting flange 24 which is normal to side panel 22. On the opposite side of trim strip 10 is an elongated J-shaped channel 60 defined by side panel 16, second flange 14 which extends normal to side panel 16, and third flange 12 which extends normal to second flange 14 and parallel to side panel 16. The second flange 14 has a width slightly greater than the width of first flange 24, so that the first flange 24 of one strip 10 nests in J-shaped channel 60 of an adjacent strip 10, as described below.

An optional elongated, double-sided, foam adhesive strip 170 can be applied in channel 60 to adhere to second flange 14. A series of trim strips 10*a*, 10*b*, 10*c*, etc., are then fastened to the joists 80 using suitable fasteners 94, such as corrosion-resistant or galvanized steel nails, or preferably screws, with the first flange 24 of one strip 10*a* nesting in the bottom of the J-shaped channel 60 of the adjacent strip 10*b*, and optionally being secured to the adjoining strip 10*b* by double-sided adhesive strip 170.

Figure 5:
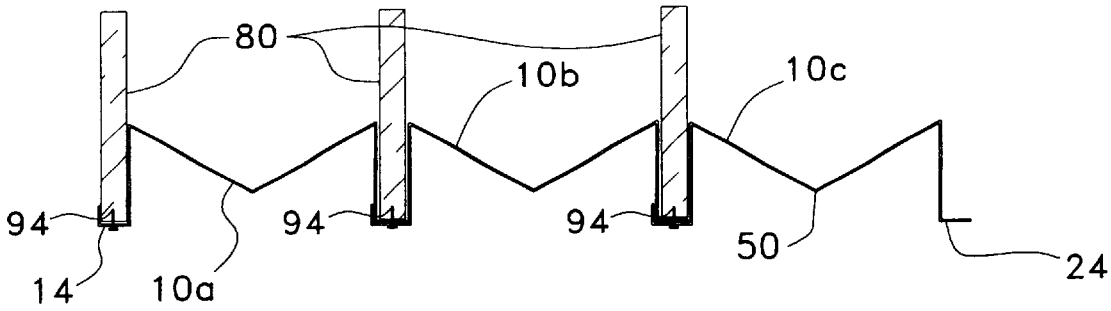
FIG. 5 shows a section view of a plurality of the protective trim strips of FIG. 2A attached to adjacent joists, the deck planks being omitted.

When installed on the underside of the joists 80 as in FIG. 5, surface water on the top surface 82 of the deck 100 will drain between the decking planks and fall into the V-shaped channel or trough between center panels 18 and 20. In order to ensure that the water will flow in the V-shaped channel, the V-shaped channel slopes downward as it extends away from the building, the channel sloping downward at a rate of about one inch per four feet as the protective trim strip 10 extends from the building wall 92 to the far end of the deck 100. The channel has a uniform depth throughout its length, but the width (or, height when viewed from the side) of the side panels 16 and 22 decreases from a width of about five inches at a first end 35 attached adjacent the building, to a width of about three inches at a second end 45 farthest from the building. It will be noted in FIG. 2A that the front edge and the rear edge of side panels 16 and 22 are perpendicular with the top edge of the side panels, while the front edge and the rear edge of the side panels are not perpendicular with the bottom edge of the side panels 16 and 22, i.e., the bottom edge of the side panels has a greater length than the top edge, while the V-shaped trough has a uniform depth. The advantage of this construction is that the protective trim strip 10 can be switched from the under-joist to the over-joist configuration by flipping the strip 180° about its longitudinal axis and reversing the first 35 and second 45 ends, as described below.

Figure 4:
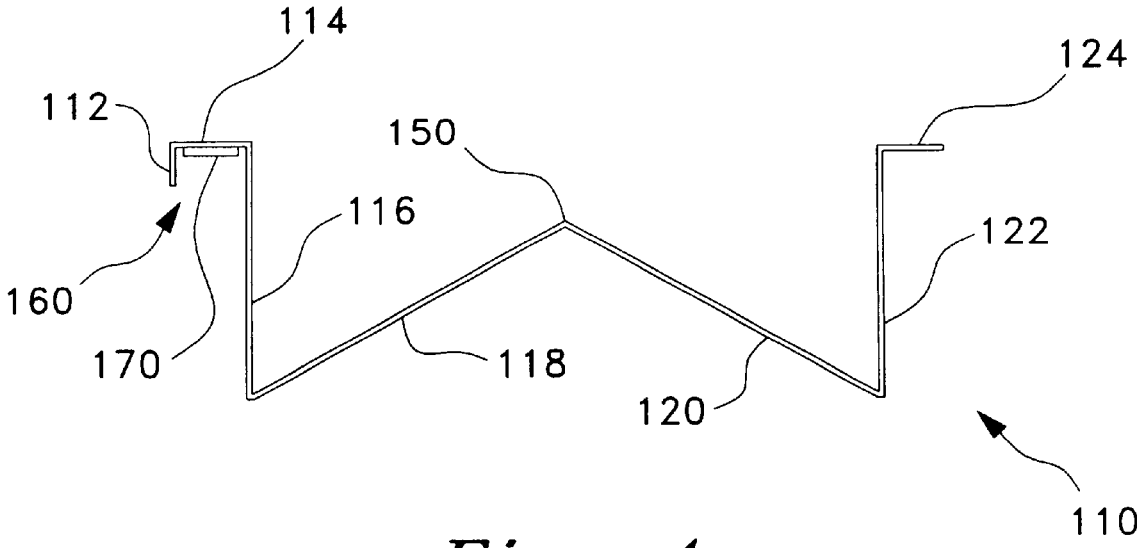
FIG. 4 shows an end view of the protective trim strip of FIG. 2B.

Details of the over-joist trim strip will be discussed in relation to FIGS. 2B, 4 and 6. The over-joist trim strips 110 are applied to the tops of the joists 80 as in the left side of the deck 100 of FIG. 1. As shown, the over-joist strips 110 can only be applied to the joists 80 before the deck planks are attached. This can take place either during the construction of a new deck, or if the deck planks of an existing deck are removed to expose the top edge of the joists 80. Since the latter situation is highly unlikely because of the costs and time involved, the under-joist trim strips 10 are instead preferably applied to the deck for retrofitting an existing deck with the protective trim strips of the present invention.

Figure 2B:
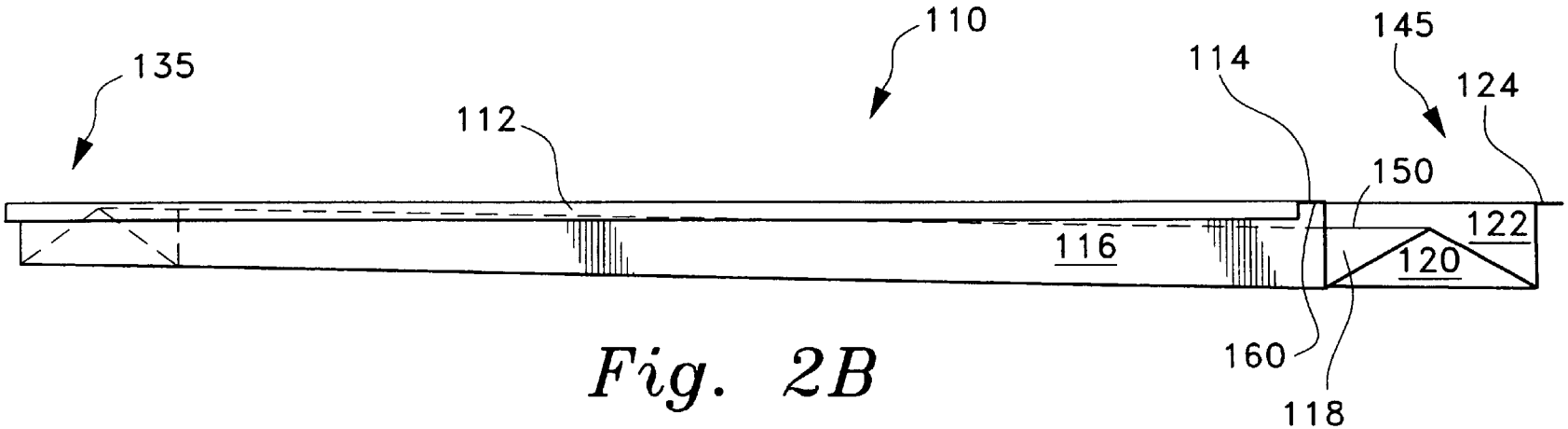
FIG. 2B shows a side perspective view of a protective trim strip according to the present invention configured in a "W" shape in section for attachment to the top edges of the joists.

As shown in FIG. 2B, two center panels 118 and 120 are connected along a common edge forming a ridge 150. An inverted V-shaped channel formed between these panels extends the entire length of the strip 110, as shown partially in hidden lines in FIG. 2B, defining two parallel drainage troughs on opposite sides of the ridge 150. Two parallel side panels 116 and 122 are connected to the center panels, 118 and 120, respectively.

Extending from side panel 122 is an outwardly projecting flange 124 which extends normal to side panel 122. On the opposite side of trim strip 110 is an elongated, inverted J-shaped channel 160 defined by second flange 114 extending normal to side panel 116, and third flange 112 extending normal to second flange 114 and parallel to side panel 116. The second flange 114 has a width slightly greater than the width of first flange 124, so that first flange 124 of one strip 110 nests in inverted J-shaped channel 160 of an adjacent strip 110, as described below. An optional elongated foam double-sided adhesive strip 170 can be applied to the channel 160 to adhere the second flange 114 in channel 160 of the trim strip 110. A series of trim strips are fastened to the top edge of joists 80 using suitable fasteners 194, such as corrosion-resistant or galvanized steel nails, or preferably, screws.

Figure 6:
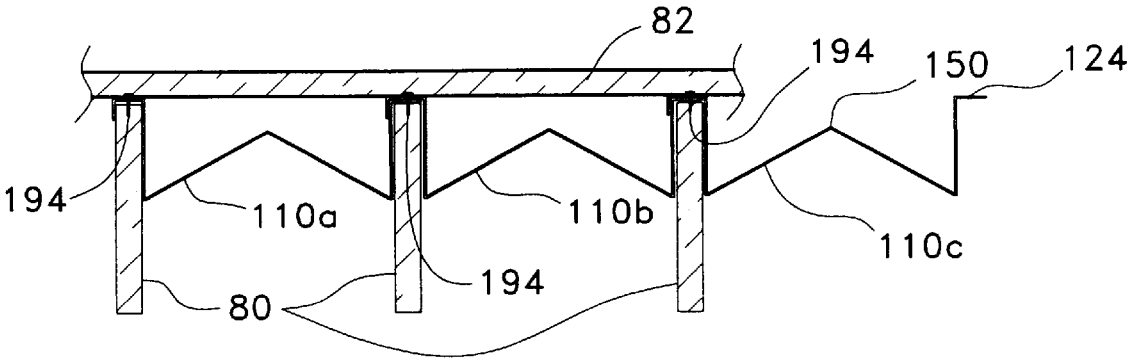
FIG. 6 shows a section view of a plurality of the protective trim strips of FIG. 2B attached to adjacent joists.

When installed on the top edges of the joists 80 as in FIG. 6, surface water on the top surface 82 of the deck 100 will drain between the decking planks and fall into the parallel drainage troughs defined on opposite sides of ridge 150. In order to ensure that water will flow through the drainage troughs, the troughs slope downward from a first end 135 adapted for attachment adjacent the building wall 92 to an opposite second end 145 at the opposite end of the deck 100. Side panels 116 and 122 taper in height from about three inches at the first end 135 to about five inches at the second end 145. The configuration can be obtained by changing the orientation of protective strip 10, by flipping the strip 10 by 180° about its longitudinal axis and reversing the first 35 and second 45 ends, as mentioned above.

As shown in FIG. 6, adjacent protective trim strips 110*a*, 110*b*, 110*c*, etc. are attached to the top edges of the joists by fasteners 194, with the first flange 124 of one strip 110*a* nested in the J-shaped channel 160 of the adjacent strip 110*b*, with the flange 124 optionally secured to the J-shaped channel 160 by double sided adhesive strip 170.

Figure 7:
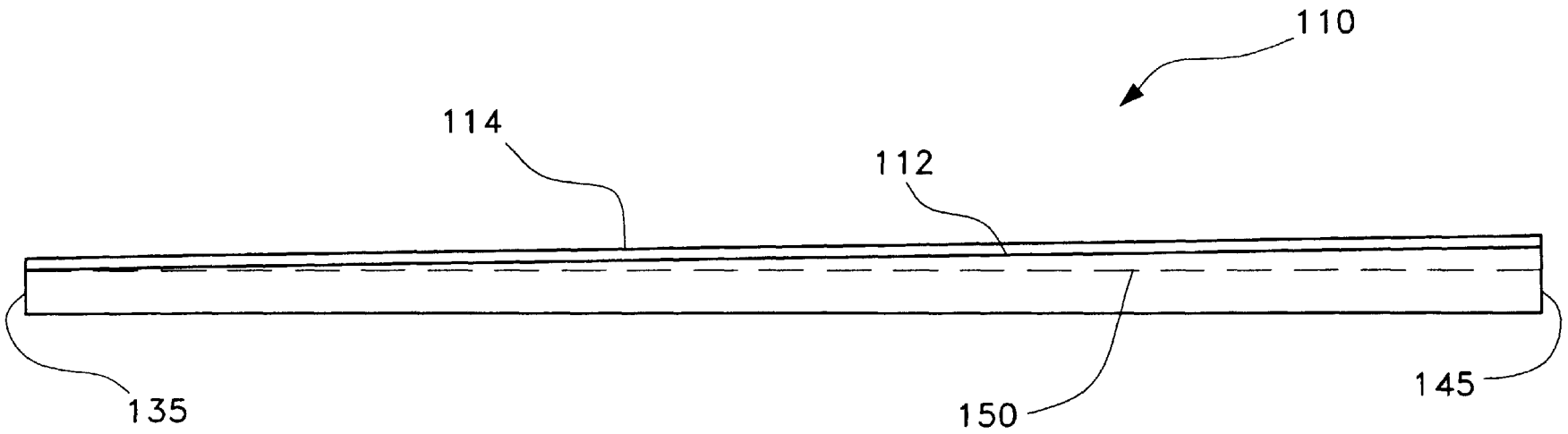
FIG. 7 is an elevational view of the protective trim strip of FIG. 2B.

FIG. 7 shows an elevation view of the over-joist trim strip 110 (i.e., having the "W" orientation), showing the changing height of the side panels of the strip from the end 135 that, when installed, is closest to the building to the opposite end 145 farthest from the building.

The strips can be made of any suitable material that can be fastened to the joists including aluminum and vinyl-based materials, such as are commonly used for making siding strips for homes.

Exemplary dimensions of the protective trim strip 10 and 110 include: length of eight or twelve feet and overall width of about seventeen inches; side panel 16, 22, 116, 122 have a length of eight or twelve feet and heights tapering along the length from three to five inches; outwardly projecting first flanges 24 and 124 having a length of eight or twelve feet and a width of about one and one-half inches; outwardly projecting second flanges 14 and 114 having a length of eight or twelve feet and a width of about one and three-quarter inches; third flanges 12 and 112 having a length of eight or twelve feet and a height of about one inch; and all panels and flanges having a thickness of about 0.046 inches.

It is to be understood that the present invention is not limited to the embodiments described above, but encompasses any and all embodiments within the scope of the following claims.

I claim:

1. A protective trim strip for decks, comprising:

a first elongated, rectangular center panel and a second elongated, rectangular panel, said first and second panels having elongated, opposed first and second edges, the first edges of said first and second center panels being joined to form a V-shape;

a first elongated side panel joined to the second edge of said first center panel;

a second elongated side panel joined to the second edge of said second center panel, said second side panel being disposed parallel to said first side panel;

a first elongated flange extending normal to said first side panel; and a second elongated flange extending normal to said second side panel and a third elongated flange extending normal to said second flange and parallel to said second side panel, said second side panel and said second and third flanges defining a J-shaped channel having a width slightly greater than said first flange, said J-shaped channel being adapted for receiving an edge of a deck joist;

wherein a plurality of protective trim sheets are adapted for attachment between joists of a deck with a single protective trim sheet extending between each adjacent pair of joists, said first flange of one protective trim sheet being nested in said J-shaped channel of an adjacent protective trim sheet, whereby surface water falling through a deck surface is carried away from an end of the deck by the protective trim sheets.

2. The protective trim sheet according to claim 1, wherein said first and second side panels have a first end and a second end, said first and second side panels tapering in width, being narrow at the first end and broad at the second end.

3. A method of attaching the protective sheet according to claim 2 to a deck extending from a building, comprising the steps of:

orienting the protective strip with the second end adjacent the building; and attaching the J-shaped channel and the first flange to a bottom edge of adjacent joists;

wherein the protective strip has an M-shaped configuration in transverse section and the first and second panels form a V-shaped trough sloping down and away from the building for carrying away surface water.

4. A method of attaching the protective sheet according to claim 2 to a deck extending from a building, comprising the steps of:

orienting the protective strip with the first end adjacent the building; and attaching the J-shaped channel and the first flange to a top edge of adjacent joists;

wherein the protective strip has a W-shaped configuration in transverse section and the first and second panels form a pair of parallel troughs sloping down and away from the building for carrying away surface water.

5. The protective trim sheet according to claim 1, wherein the protective trim sheet is formed in one piece from vinyl.

6. The protective trim sheet according to claim 1, wherein the protective trim sheet is formed in one piece from aluminum.

7. The protective trim sheet according to claim 1, further comprising an elongated strip of double-sided foam adhesive attached to the second flange.

* * * * *